US009533801B2

(12) United States Patent
Selina et al.

(10) Patent No.: US 9,533,801 B2
(45) Date of Patent: Jan. 3, 2017

(54) COLLAPSIBLE SPOUT FOR A CONTAINER AND METHOD OF MANUFACTURE THEREOF

(75) Inventors: John R. Selina, Brighton, MI (US); Randall J. Corbett, Macomb, MI (US)

(73) Assignee: Letica Corporation, Rochester, MI (US)

( * ) Notice: Subject to any disclaimer, the term of this patent is extended or adjusted under 35 U.S.C. 154(b) by 1172 days.

(21) Appl. No.: 12/898,768

(22) Filed: Oct. 6, 2010

(65) Prior Publication Data

US 2012/0085794 A1 Apr. 12, 2012

(51) Int. Cl.

| | |
|---|---|
| ***B67D 3/00*** | (2006.01) |
| ***B67D 7/06*** | (2010.01) |
| ***B65D 47/06*** | (2006.01) |

(52) U.S. Cl.

CPC ..... *B65D 47/063* (2013.01)

(58) Field of Classification Search

USPC ..... 222/530, 570, 527, 566, 567, 569

See application file for complete search history.

(56) References Cited

U.S. PATENT DOCUMENTS

| | | | | |
|---|---|---|---|---|
| 1,804,627 | A * | 5/1931 | Lukenbill | 215/363 |
| 2,561,596 | A * | 7/1951 | Rieke | 222/527 |
| 3,580,427 | A | 5/1971 | Clarke | |
| 3,604,740 | A * | 9/1971 | Summers | 292/256.61 |
| 4,073,413 | A * | 2/1978 | Tabler et al. | 222/529 |
| 4,403,709 | A * | 9/1983 | Meins et al. | 220/703 |
| 4,428,507 | A | 1/1984 | Sneider | |
| 4,602,728 | A * | 7/1986 | Ha | 222/528 |
| 4,632,282 | A * | 12/1986 | Nagashima | 222/529 |
| 4,921,147 | A * | 5/1990 | Poirier | 222/527 |
| 5,230,442 | A * | 7/1993 | Dean, Jr. | 222/108 |
| 5,722,570 | A * | 3/1998 | Sultzer et al. | 222/529 |
| 5,799,813 | A | 9/1998 | Letica | |
| 5,975,380 | A | 11/1999 | West, Jr. | |
| 6,641,007 | B2 * | 11/2003 | Chung et al. | 222/529 |
| 2004/0118880 | A1 * | 6/2004 | Arciniegas et al. | 222/530 |
| 2004/0188474 | A1 | 9/2004 | Johnston Wills | |
| 2007/0056996 | A1 * | 3/2007 | Zijing et al. | 222/530 |
| 2008/0029559 | A1 * | 2/2008 | Selina et al. | 222/570 |
| 2011/0114679 | A1 * | 5/2011 | Park | 222/528 |

* cited by examiner

*Primary Examiner* — Kevin P Shaver
*Assistant Examiner* — Jeremy W Carroll
(74) *Attorney, Agent, or Firm* — Young Basile Hanlon & MacFarlane, P.C.

(57) ABSTRACT

A manually extendible plastic spout for use in combination with the closure for an industrial container. The spout has a peripheral flange with a U-shaped channel which receives a downwardly extending flange on the closure so that the spout is installed from the bottom side of the closure rather than according to the more customary top-mounted procedure. The body of the spout is pleated and has an outlet collar which is threaded to receive a cap having a pull-ring, an integral internal seal is also provided. The spout can be extended to any of several stable positions or conditions.

7 Claims, 4 Drawing Sheets

COLLAPSIBLE SPOUT FOR A CONTAINER AND METHOD OF MANUFACTURE THEREOF

FIELD OF THE INVENTION

This invention relates to collapsible spouts for installation in closures for open top containers and more particularly to a spout having a reconfigurable body which is manually extendible from a collapsed condition within an opening in the closure to a stable, extended condition in which pouring from the container is facilitated.

BACKGROUND OF THE INVENTION

It is known to install collapsible, but manually extendible, spouts in the closure decks of industrial containers for the purpose of facilitating the act of pouring out the contents of the container. One common spout uses a "roll sock" configuration wherein the soft plastic body of the spout is gradually turned inside out as the spout is extended. Roll sock spouts typically have three pieces and are of limited height.

SUMMARY OF THE INVENTION

The present invention provides an improved collapsible, manually extendible spout which is characterized by fewer parts and greater height potential. In general, the spout of the present invention comprises a reconfigurable molded plastic body comprising, in a preferred embodiment, a plurality of concentric pleats. At the larger diameter inlet end of the body, a peripheral U-shaped channel is formed which receives a downwardly extending peripheral flange on the underside of the closure deck such that the spout is installed from and attached to the underside or interior side of the closure rather than the top or exterior side. At the other end of the pleated body, there is formed an integral and externally threaded collar which receives an internally threaded cap. This cap is normally flush with the top of the container deck when the spout is in the collapsed condition and includes a pull-ring to assist the user in extending the spout.

In the preferred embodiment described herein, the pull-ring is formed integrally with the cap and around the periphery thereof so that a person may grasp the pull-ring with two or more fingers, lift it up and away from its resting plane and exert an upward pressure on the spout through the cap so as to extend the spout into a stable partially or fully reconfigured condition.

Also in the preferred embodiment hereinafter described in detail, a seal with a pull-ring is formed integrally inside of the spout collar so as to protect the contents of the container until such time as one desires to deploy the spout and gain access to such contents.

According to a second aspect of the invention, the pleated body of the spout is molded in the collapsed condition with all of the pleats of the body as well as the outlet collar concentrically within one another in essentially the same plane.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
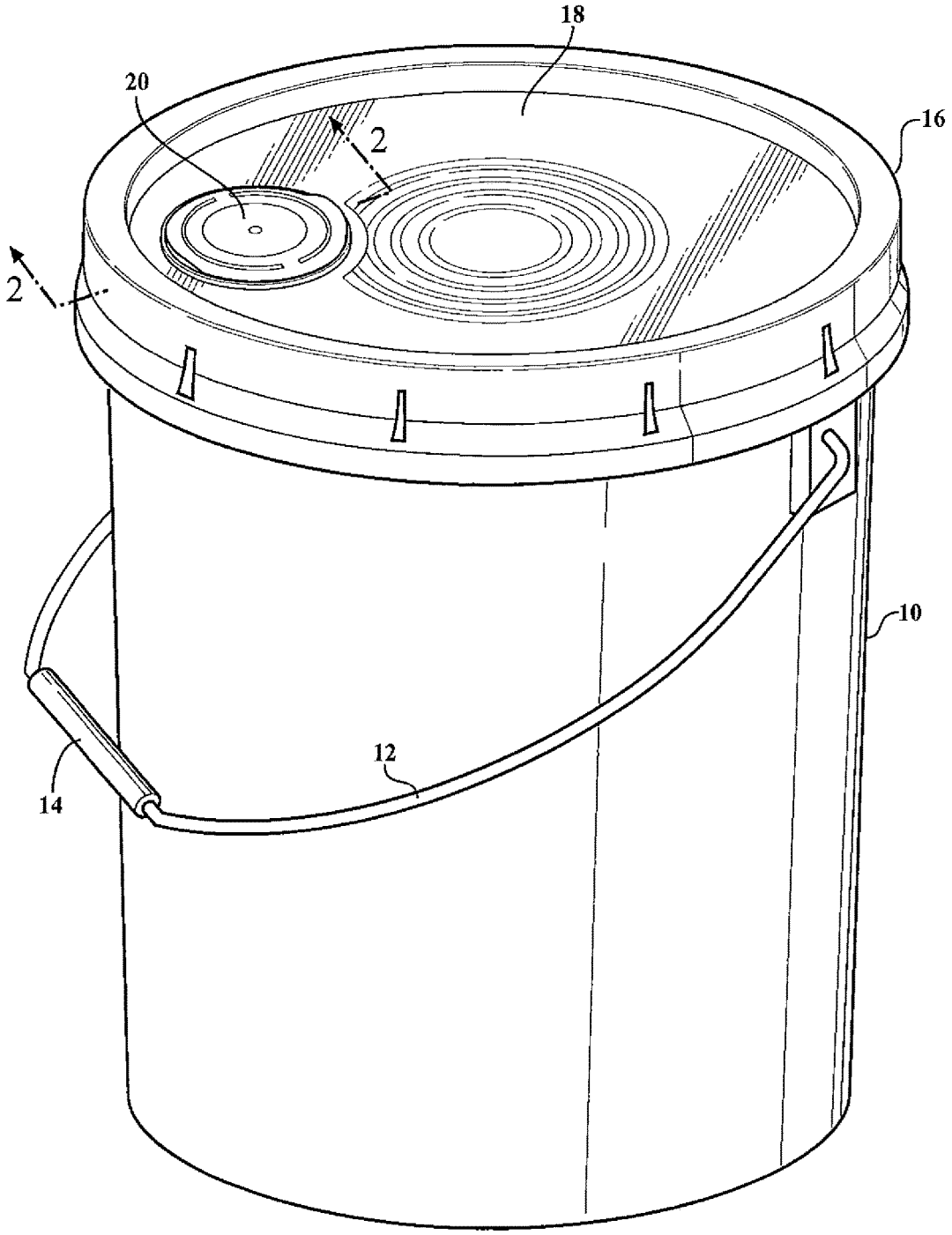
FIG. 1 is a perspective view of a container comprising a lock-on closure equipped with a collapsible spout in accordance with the invention.
Figure 2:
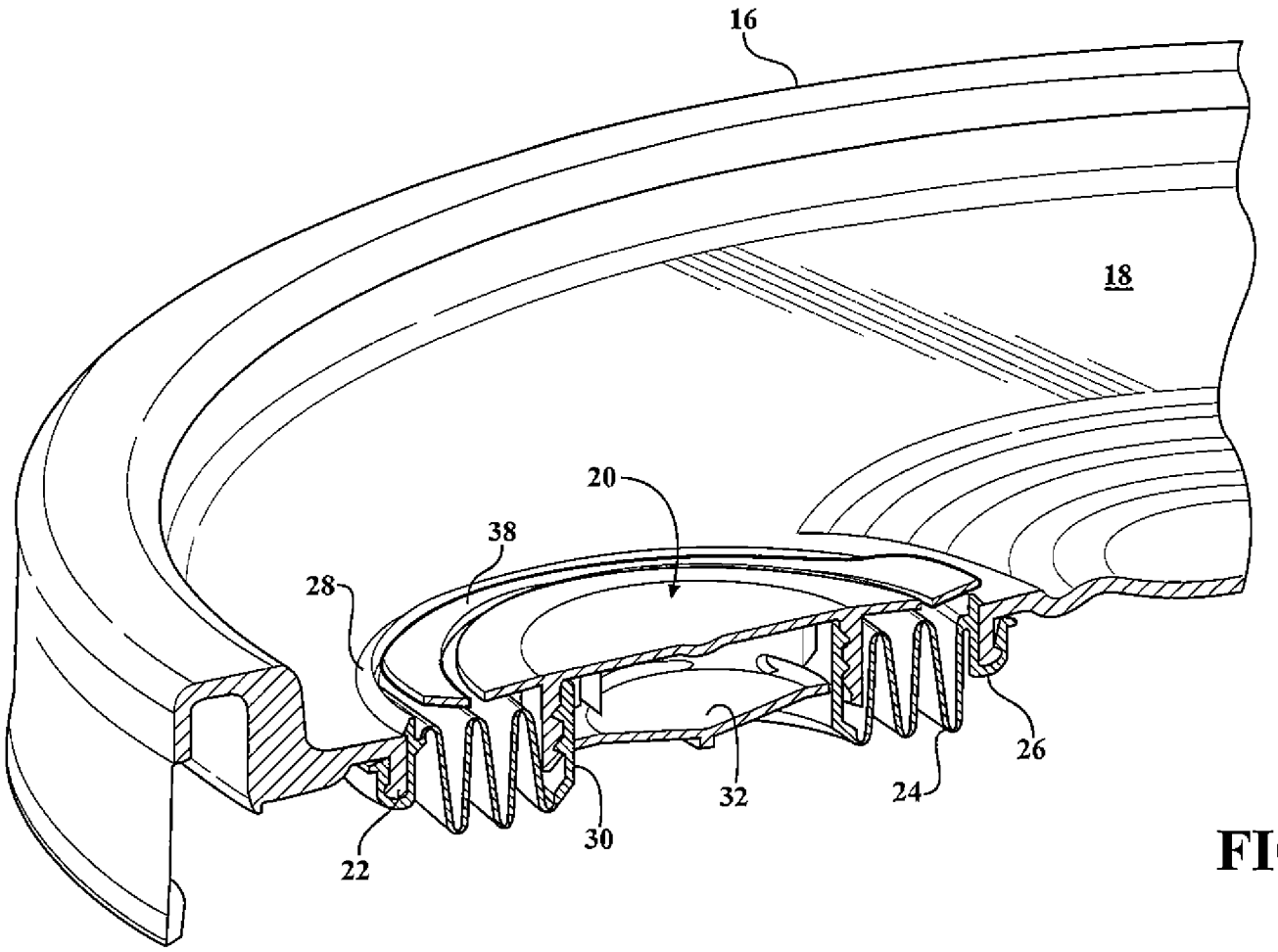
FIG. 2 is a perspective view partly in section showing the construction of the spout and the closure deck in which the spout is mounted.
Figure 3:
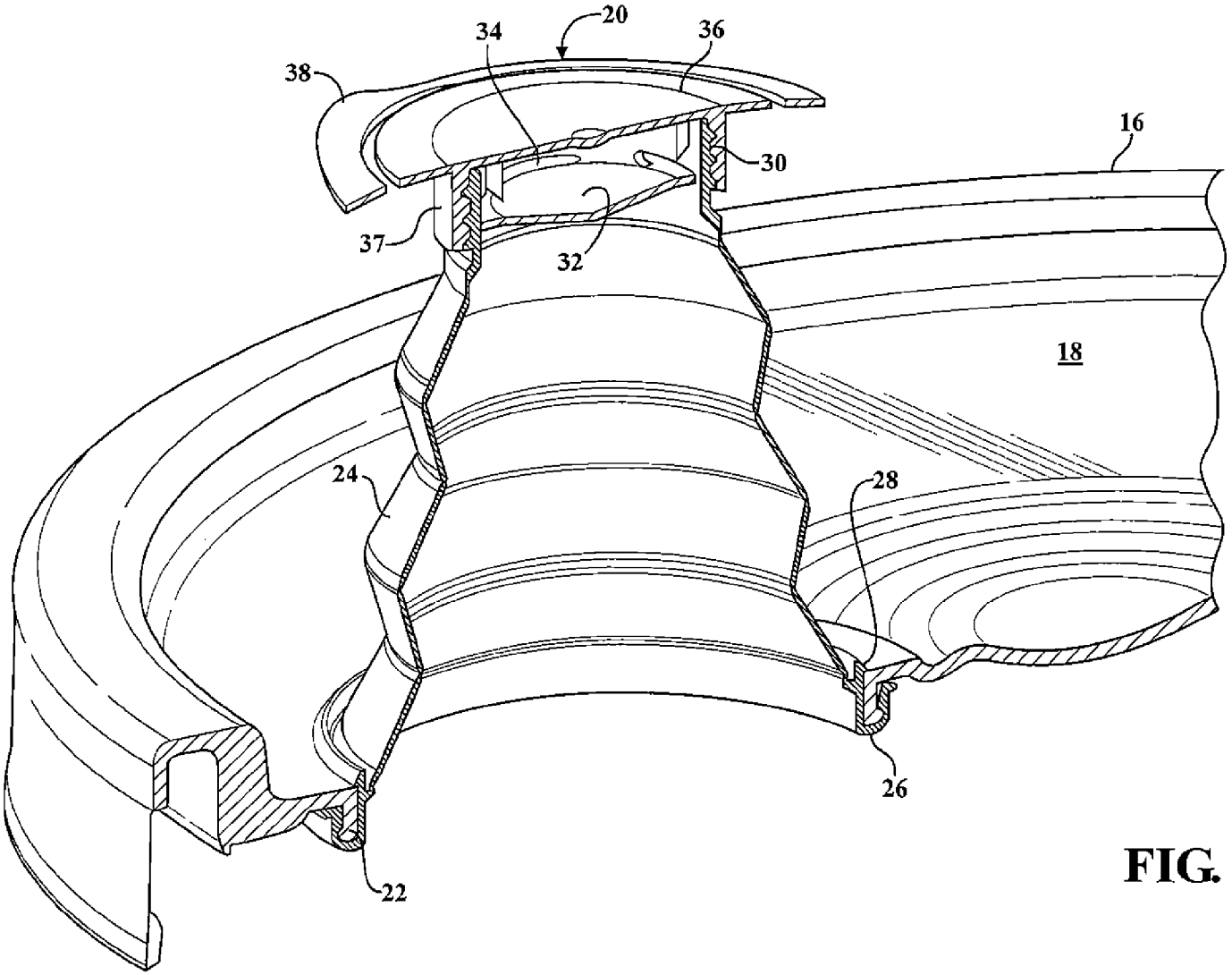
FIG. 3 shows the spout of FIG. 1. 2 in an extended condition.

Referring to FIGS. 1 through 3, a five-gallon open-top molded container 10 is shown to be equipped with a bail 12 having a handle 14. The open top (not shown) of the container 10 is sealingly closed by a molded plastic closure 16 of well known design. Both the container 10 and the closure 16 are often and advantageously injection molded of high-density polyethylene; however, many other materials of construction may be used. The size of the container is given by way of example only.

The closure 16 is characterized by a generally flat central deck 18 having formed therein a circular opening which receives therein a two-piece spout assembly 20. The opening in the deck has a downwardly (or inwardly, relative to the interior of the container 10) extending flange 22 with an annular detent head for purposes to be described.

The spout assembly 20 comprises a molded plastic, concentrically-pleated spout body 24 which is molded with the pleated portions thereof concentric and in the collapsed condition shown in FIG. 2. The body of the spout has a large diameter inlet end 26 with a U-shaped peripheral channel adapted to lockingly receive the inwardly extending flange 22 of the closure deck 18 such that the spout is installed from the interior or underside of the closure deck; i.e., the spout 24 is inserted from the underside or bottom of the deck 18 and pushed upwardly into locking engagement with the flange 22. A peripheral flange 28 on the top of the U-shaped channel 26 seats against the top of the deck 18 just around the outside of the circular opening to provide a seal.

The smaller diameter or outlet end of the spout body is defined by a generally cylindrical collar 30 having external spiral threads formed thereon to receive a cap 36 which forms the second component of the spout assembly. The cap 36 comprises a cylindrical body portion 37 with internal threads to mate with the external threads of the collar 30. The cap 36 is equipped with an integral pull-ring 38 around the outer periphery thereof to exhibit the largest possible diameter. The pull-ring 38 is partially separated from the cap body by a circular gap or slot so that the pull-ring may be lifted and grasped in the hand when one wishes to extend the spout. In short, the spout is extended by grasping the pull-ring 38 with the cap 36 attached to the collar 30 and pulling upwardly until the pleats begin to unfold into any of various stable configurations.

A secondary seal 32 is formed integrally within the collar 30 and has its own pull-ring 34 in conventional fashion for selective removal when one wishes to deploy the spout and gain access to the contents of the container.

In a practical embodiment, the circular opening in the deck 18 is on the order of three inches in diameter and the remaining components of the assembly as shown in the Figures are scaled according to that dimension. It is apparent from FIGS. 2 and 3 that the pleated spout exhibits a large extension height thus making the act of pouring from the container 10 easier and less likely to produce spills.

Figure 4:
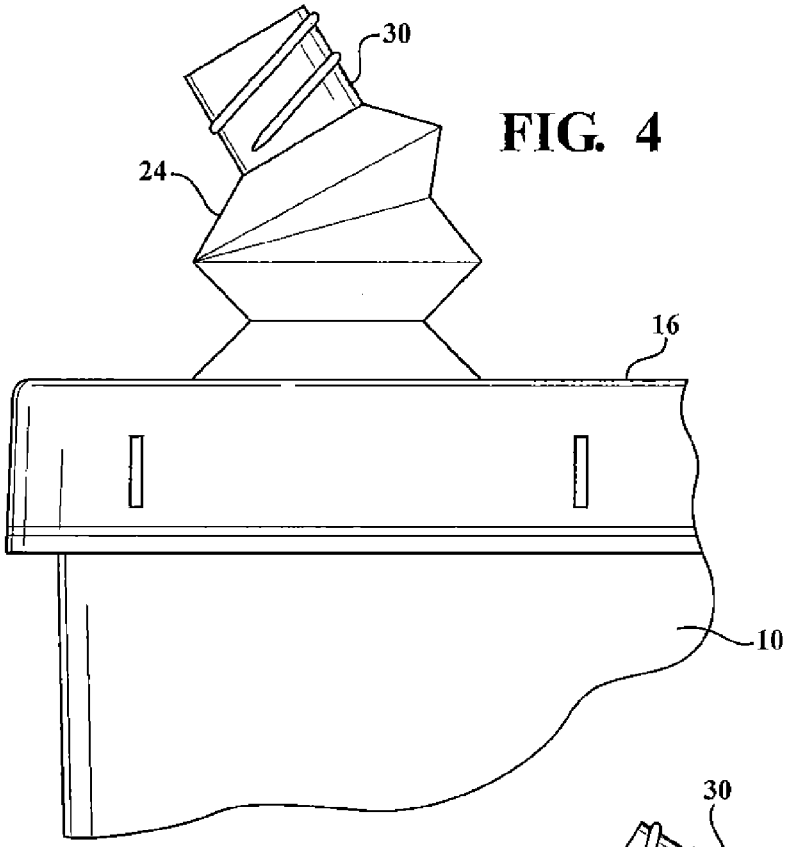
FIG. 4 is a side view of the spout showing how it can be asymmetrically extended.
Figure 5:
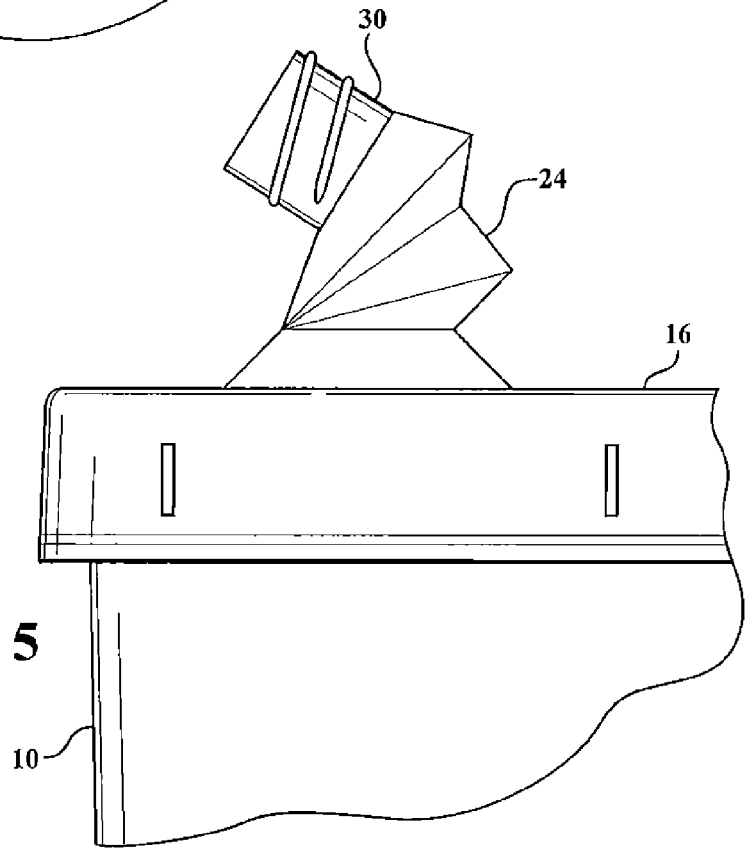
FIG. 5 is another view showing an asymmetric extension of the spout.

As shown in FIGS. 4 and 5, the spout 24 can be extended symmetrically and asymmetrically; i.e., the latter being characterized by a greater degree of pleat extension on one side of the spout than on the other thus to place the spout 24 in a "cocked" condition. The material of the body 24 tends to be thinner at the pleats and one will note an "over-center" release as each pleat is unfolded.

The method of the present invention comprises, over all the steps of providing a mold which affords the appropriate design for the spout and molding the spout in the collapsed condition with the pleats and the collar 30 concentric and essentially monoplanar.

What is claimed is:

1. A closure having a manually operable plastic spout attached thereto and extendable along an extension axis comprising:

a molded plastic closure having a deck with a top plane and a cylindrical flange forming an opening therein, the flange being substantially flush with the top plane of the deck;

an extendable plastic spout installed in said opening and having stable collapsed and extended conditions and comprising an integrally continuous plurality of annular wall sections of substantially equal axial length and thickness, but of progressively smaller diameter interconnected in series by annular hinges of thinner, more flexible construction than said wall sections to produce over-center inversion of every other one of said wall sections during extension and collapse; all of said wall sections in the collapsed condition, lay concentrically within one another with the top annular edges of the collapsed wall sections in a common plane perpendicular to the extension axis and no higher than the top plane of the deck; said spout being molded in the stable collapsed condition;

the innermost section in the collapsed condition having threads formed thereon;

a cap having a cylindrical neck portion and a larger diameter planar top portion, said neck portion having threads mating with the threads of the innermost spout section to close the spout, the planar top portion lying substantially flush with said top plane when the spout is in the collapsed condition; and an annular pull ring formed integrally with the top portion of the cap and in circumferentially surrounding relationship therewith;

said cap top portion and said pull ring together being of sufficient diameter to substantially fill the cylindrical opening in said closure deck and create a substantially flush deck structure.

2. The closure as defined in claim 1 wherein the hinges have cross-sectional dimensions which are less than the cross-sectional dimensions of said sections thereby to produce over-center inversion.

3. The closure defined in claim 1 wherein the spout is molded in the collapsed condition such that the collapsed condition is stable and extension produces an over-center inversion of every other wall section to reconfigure the spout from a stable collapsed condition to a stable extended condition.

4. The closure defined in claim 3 wherein all of the wall sections in the stable collapsed condition lie substantially parallel to the extension axis.

5. The closure defined in claim 1 wherein the spout includes a grooved outermost annular section that is snap-fit into the closure opening flange.

6. The closure defined in claim 1 wherein the threads in the innermost spout section are external and the mating threads on the cap neck are internal such that the cap screws onto the outside of the neck.

7. A molded plastic spout in combination with a molded plastic closure having a substantially flat deck with a round opening formed therein; the spout having an extension axis along which the spout can be extended from a collapsed condition above the top plane of the deck to an extended condition and comprising at least five annular wall sections of equal axial length and thickness, but of progressively decreasing diameter, the outermost section of the spout being connected to the deck opening below the top plane of the deck; all of said sections in the collapsed and connected condition, lie concentrically within one another with said wall sections substantially parallel to the extension axis; said wall sections being integrally interconnected by annular molded hinges between said wall sections wherein said hinges are thinner than said wall sections to allow over-center of every other of said wall sections during extension of said spout, and a cap threaded attached to the innermost section and lying in a plane substantially flush with the top plane of the deck; said spout being molded in the stable collapsed condition.

* * * * *